US011198073B2

(12) United States Patent
Lunde et al.

(10) Patent No.: US 11,198,073 B2
(45) Date of Patent: Dec. 14, 2021

(54) APPARATUS FOR PRODUCING A FIRE SPECIAL EFFECT

(71) Applicant: Technifex Products, LLC, Valencia, CA (US)

(72) Inventors: Montgomery C. Lunde, Marina del Rey, CA (US); Rockne J. Hall, Newhall, CA (US); Ryan G. Lunde, Santa Clarita, CA (US); Matthew A. Case, Sylmar, CA (US)

(73) Assignee: Technifex Products, LLC, Valencia, CA (US)

( * ) Notice: Subject to any disclaimer, the term of this patent is extended or adjusted under 35 U.S.C. 154(b) by 366 days.

(21) Appl. No.: 16/188,984

(22) Filed: Nov. 13, 2018

(65) Prior Publication Data

US 2019/0143238 A1 May 16, 2019

Related U.S. Application Data

(60) Provisional application No. 62/585,483, filed on Nov. 13, 2017.

(51) Int. Cl.

| | |
|---|---|
| ***A63J 5/02*** | (2006.01) |
| ***F21S 10/04*** | (2006.01) |
| ***A63J 25/00*** | (2009.01) |
| ***F17C 7/04*** | (2006.01) |

(52) U.S. Cl.

CPC ..... *A63J 5/025* (2013.01); *A63J 5/023* (2013.01); *A63J 25/00* (2013.01); *F17C 7/04* (2013.01); *F21S 10/04* (2013.01)

(58) Field of Classification Search

None

See application file for complete search history.

(56) References Cited

U.S. PATENT DOCUMENTS

| | | | | |
|---|---|---|---|---|
| 643,493 | A | 2/1900 | Fuller | |
| 1,339,207 | A * | 5/1920 | Lindemann | F23D 3/00 431/195 |
| 1,385,263 | A * | 7/1921 | Nelson | F23D 14/04 239/555 |
| 1,388,238 | A * | 8/1921 | Chappelle | F24C 3/042 126/87 |
| 1,407,871 | A * | 2/1922 | Knudsen | F23D 14/00 239/425.5 |

(Continued)

FOREIGN PATENT DOCUMENTS

DE 3921407 A1 1/1991

*Primary Examiner* — Thor S Campbell

(74) *Attorney, Agent, or Firm* — James A. Sheridan; Sheridan Law, LLC

(57) ABSTRACT

The invention is directed to an apparatus for use in producing a simulated flame/fire effect using steam or theatrical smoke. In one embodiment, the apparatus includes an first chamber for receiving steam or theatrical smoke, an annular second chamber that surrounds the first chamber and defines an annular closed-loop slot through which a closed-loop sheet of steam or theatrical smoke exits, a passageway for conveying smoke from the first chamber to the annular second chamber, a lighting structure for projecting light onto the steam or theatrical smoke exiting the annular slot, and an air modulator for modulating the position of the steam or theatrical smoke exiting the slot.

20 Claims, 10 Drawing Sheets

(56) References Cited

U.S. PATENT DOCUMENTS 1,411,749 A * 4/1922 Schulenberg ..... F23D 3/00 431/201
1,657,725 A * 1/1928 Schutz ..... F23C 3/008 110/261
1,684,990 A * 9/1928 Inglis ..... F23C 99/00 431/65
1,724,752 A * 8/1929 Deemar ..... F24H 3/08 126/90 A
1,848,206 A * 3/1932 Sherman ..... F23D 3/00 431/200
2,010,634 A * 8/1935 Hillhouse ..... C10J 3/00 48/206
2,099,704 A * 11/1937 Pirich ..... F23M 9/06 110/323
2,607,334 A * 8/1952 Perlman ..... A47J 36/24 126/9 R
3,044,301 A * 7/1962 Bennett ..... B64G 7/00 73/865.6
3,153,104 A * 10/1964 Sprauer ..... C07C 4/04 585/541
3,334,816 A * 8/1967 Mizuno ..... B05B 17/08 239/18
3,432,439 A 3/1969 Dickman
4,002,333 A 1/1977 Gotoh
4,026,544 A 5/1977 Plambeck et al.
4,426,021 A 1/1984 Rosenthal
4,568,288 A * 2/1986 Patteson ..... G09B 25/02 434/219
4,907,330 A * 3/1990 Akao ..... F02B 19/165 123/90.51
4,974,779 A * 12/1990 Araki ..... G03B 21/608 239/18
4,994,092 A 2/1991 Eklund et al.
5,156,333 A 10/1992 Worsfold
5,407,392 A 4/1995 Laljoki-Puska
5,550,610 A * 8/1996 DeMarco ..... G03B 11/00 396/544
5,790,013 A 8/1998 Hauck
5,882,717 A * 3/1999 Panesar ..... A23F 5/40 426/595
5,989,128 A 11/1999 Baker et al.
6,363,636 B1 4/2002 Hess et al.
6,685,574 B2 2/2004 Hall
6,802,782 B2 10/2004 Hall et al.
6,953,401 B2 10/2005 Starr
7,300,179 B1 11/2007 LaDuke et al.
7,641,361 B2 1/2010 Wedell et al.
7,686,471 B2 * 3/2010 Reichow ..... F21S 10/04 362/161
7,762,897 B2 7/2010 Starr et al.
7,837,355 B2 11/2010 Schnuckle
7,850,533 B2 12/2010 Osterman et al.
8,028,438 B2 10/2011 Pedtke
8,070,319 B2 12/2011 Schnuckle et al.
8,342,712 B2 1/2013 Patton et al.
8,523,692 B2 9/2013 Osterman et al.
8,534,869 B2 9/2013 Patton et al.
8,550,660 B2 10/2013 Patton et al.
8,646,946 B2 2/2014 Schnuckle et al.
8,696,166 B2 4/2014 Patton et al.
8,721,118 B2 5/2014 Patton et al.
8,727,569 B2 5/2014 Schnuckle et al.
8,800,933 B2 8/2014 Dunn
9,068,706 B2 6/2015 Fournier et al.
9,366,402 B2 6/2016 Li
9,371,973 B2 6/2016 Li
9,384,673 B1 7/2016 Jahnke
9,447,937 B2 9/2016 Fournier et al.
9,447,938 B2 9/2016 Li
9,512,971 B2 12/2016 Li
9,518,710 B2 12/2016 Li
9,523,471 B2 12/2016 Li
9,551,470 B2 1/2017 Li
9,585,980 B1 3/2017 Li
9,605,824 B1 3/2017 Li
9,625,112 B2 4/2017 Li
9,689,538 B2 6/2017 Hau et al.
9,689,544 B2 * 6/2017 Green, Jr. ..... F21V 23/006
9,695,839 B1 * 7/2017 Polston ..... F04F 1/18
9,709,231 B2 7/2017 Li
9,739,432 B2 8/2017 Li
9,810,388 B1 11/2017 Li
9,949,346 B2 * 4/2018 Patton ..... F21S 10/043
10,010,640 B1 7/2018 Li
10,018,313 B2 7/2018 Schnuckle et al.
10,018,362 B1 * 7/2018 Swanson ..... F24B 1/183
10,024,507 B2 7/2018 Fournier et al.
10,060,585 B2 8/2018 Li
10,111,307 B2 10/2018 Li
10,112,203 B2 * 10/2018 Kubicek ..... A61L 9/122
10,125,937 B2 11/2018 Green, Jr. et al.
10,145,562 B1 * 12/2018 Swanson ..... F24C 7/004
10,215,353 B2 * 2/2019 Thompson ..... F21S 10/046
10,675,553 B1 * 6/2020 Witt ..... A63J 5/023
2002/0080601 A1 * 6/2002 Meltzer ..... F24C 7/004 362/96
2003/0053305 A1 * 3/2003 Lin ..... F21S 10/04 362/96
2003/0190966 A1 * 10/2003 Hall ..... A63J 5/023 472/65
2004/0077416 A1 * 4/2004 Hall ..... A63J 5/023 472/57
2005/0101393 A1 * 5/2005 Starr ..... A63J 5/023 472/65
2006/0275721 A1 * 12/2006 Starr ..... G09F 19/12 431/125
2008/0112154 A1 5/2008 Reichow
2008/0130266 A1 * 6/2008 DeWitt ..... A61L 9/12 362/96
2008/0146358 A1 6/2008 Osterman et al.
2008/0291663 A1 * 11/2008 Wedell ..... F21V 19/0055 362/147
2010/0031543 A1 2/2010 Rice et al.
2011/0019422 A1 1/2011 Schnuckle et al.
2011/0045302 A1 2/2011 Osterman et al.
2011/0127914 A1 6/2011 Patton et al.
2012/0208133 A1 * 8/2012 Thielvoldt ..... F23C 6/047 431/8
2014/0168946 A1 * 6/2014 Kaplan ..... A63J 5/025 362/96
2015/0103510 A1 * 4/2015 Reetz ..... F21S 10/00 362/84
2015/0338086 A1 11/2015 Patton
2017/0198902 A1 * 7/2017 Zink ..... F23D 14/24
2018/0347818 A1 * 12/2018 Birnbaum ..... F24C 7/004

* cited by examiner

APPARATUS FOR PRODUCING A FIRE SPECIAL EFFECT

CROSS REFERENCE TO RELATED APPLICATIONS

This application claims the benefit of U.S. provisional patent application No. 62/585,483, entitled "Simulated Fire Effect Using Theatrical Smoke" and filed on Nov. 13, 2017, which application is incorporated by reference into this application in its entirety.

FIELD OF THE INVENTION

The present invention is directed to a special effect device and, more specifically, to a special effect for producing a simulated flame or fire effect.

BACKGROUND OF THE INVENTION

The use of a simulated fire or flame is desirable in many applications. For instance, in many theme park attractions (e.g., volcano, battle scene and disaster scenes), the use of a simulated flame or fire is preferred relative to a real flame or fire for a number of reasons. For instance, a real flame or fire must typically be located a substantial distance from an audience to prevent members of the audience from coming into contact with the fire or flame. Further, with respect to attractions that are located indoors, a real flame or fire produces heat and smoke that typically require additional air conditioning and ventilation. In contrast, several types of simulated flame or fire effects can be located close to an audience and do not typically impose the air conditioning and ventilation requirements of a real flame or fire.

There are many types of devices for producing simulated flames or fire. For example, one type of device blows strips of colored material, such as silk, up into the air and shines an appropriately colored light onto the strips. From a distance, these devices provide a reasonably convincing simulated flame or fire. At the other end of the spectrum are devices that provide a television or video monitor with a signal of a pre-recorded fire or flame. Such devices are impractical in theme park applications that require a flame or fire that extends over a distance that is greater than the typical width and height of a video monitor or television. Yet a further type of device involves the use of a screen of atomized water and the projection of an image or light on the screen that creates the illusion of a flame or fire. Also known are devices that generate use theatrical smoke or steam in creating the illusion of a fire or flame. Among these devices are the devices disclosed in U.S. Pat. Nos. 6,685,574, 6,802,782, 6,953,401, and 7,762,897.

SUMMARY OF THE INVENTION

The invention disclosed herein is directed to an apparatus for creating a fire or flame special effect using steam or theatrical smoke where the apparatus needs to facilitate the illusion of a fire/flame over a relatively large two-dimensional area. In such an application, a relatively even distribution of steam or theatrical smoke is required to produce a convincing fire/flame effect. An example of an application requiring a simulated fire/flame needed over a relatively large two-dimensional area and a relatively even distribution of steam or theatrical smoke to be convincing is a simulated campfire that is two to three feet in diameter.

In one embodiment, the apparatus includes a pipe for providing a stream of gas, first chamber for receiving a stream of gas the pipe and a second chamber that surrounds the first chamber. As such, the second chamber can be characterized as an annular chamber. The second chamber also defines an annular closed-loop slot for directing a closed-loop sheet of gas into the ambient atmosphere. As should be appreciated, the sheet of gas has a somewhat opaque characteristic that, when light is projected onto the sheet of gas, reflects that light and thereby facilitates the creation of a simulated flame or fire. In this regard, two gaseous substances that can be used to produce the simulated flame or fire effect are steam and theatrical smoke. The apparatus also includes a passageway for conveying the gas from the first chamber to the second chamber. The passageway can also be characterized as being annular and can be a single continuous passageway or comprised of multiple sub-passageways that define a closed-loop. In operation, the apparatus causes a relatively even steam or theatrical smoke received in the first chamber to pass through the passageway and through the annular closed-loop slot. A lighting structure that creates the appropriately colored light or lights is projected onto the closed-loop sheet of gas that exits the closed-loop annular slot to establish the desired color or colors for the fire/flame effect. For instance, in the case of a simulated campfire, the lighting structure will typically project red and yellow colors onto the closed-loop sheet of gas.

Depending on the application, the closed-loop sheet of gas may need to be modulated to create a convincing simulated flame/fire effect. In one embodiment, the apparatus further includes an air modulator for blowing air at the closed-loop. In a particular embodiment, the air modulator includes a third annular chamber that is positioned adjacent to the closed-loop annular slot and defines a plurality of orifices that are positioned to direct streams of air at the closed-loop sheet of gas exiting the closed-loop annular slot. The air modulator employs one or more fans to force air into the third annular chamber and out through the orifices. In another embodiment, the apparatus includes a "skin" with one or more portions of the skin positioned adjacent to closed-loop annular slot so as to affect movement of the gas exiting the slot. For instance, in the case of a "campfire skin," the skin may include simulated logs or rocks that are positioned adjacent to the annular closed-loop slot and affect the manner in which those portions of the annular sheet of gas adjacent to the logs or rocks move after exiting the annular closed-loop slot.

In an embodiment of the apparatus in which theatrical smoke is employed in creating the simulated flame/fire effect, the relatively even distribution of the flow of the theatrical smoke from the first chamber to the second chamber has been found to be enhanced by positioning the end of the pipe that injects the theatrical smoke into the first chamber such the smoke is directed at the bottom surface of the chamber. Further, a fan is employed to facilitate the movement of the theatrical smoke out of the first chamber, through the passageway and into the second chamber. In contrast, in an embodiment of the apparatus in which steam is employed in creating the simulated flame/fire effect, the relatively even distribution of the flow of the steam from the first chamber into the second chamber has been found to be enhanced by directing the steam away from the bottom surface of the chamber. In a particular embodiment, the steam is also distributed within the first chamber by employing a manifold with multiple orifices for injecting the steam at various locations throughout the first chamber. In a particular embodiment, the manifold is located farther from the bottom surface of the first chamber than the passageway.

DETAILED DESCRIPTION

Figure 1A:
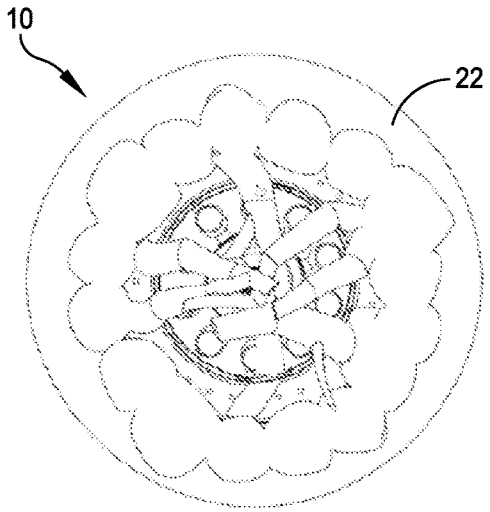
FIGS. 1A and 1B respectively are a top view and side view of an embodiment of a special effect device for producing a simulated flame or fire effect using theatrical smoke to simulate a campfire.
Figure 1B:
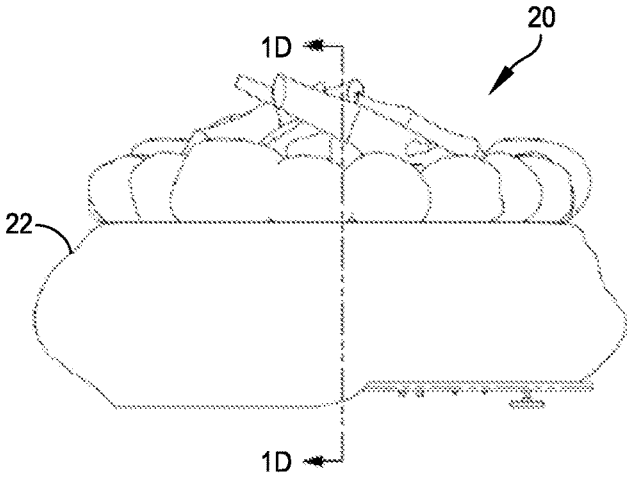
Figure 1C:
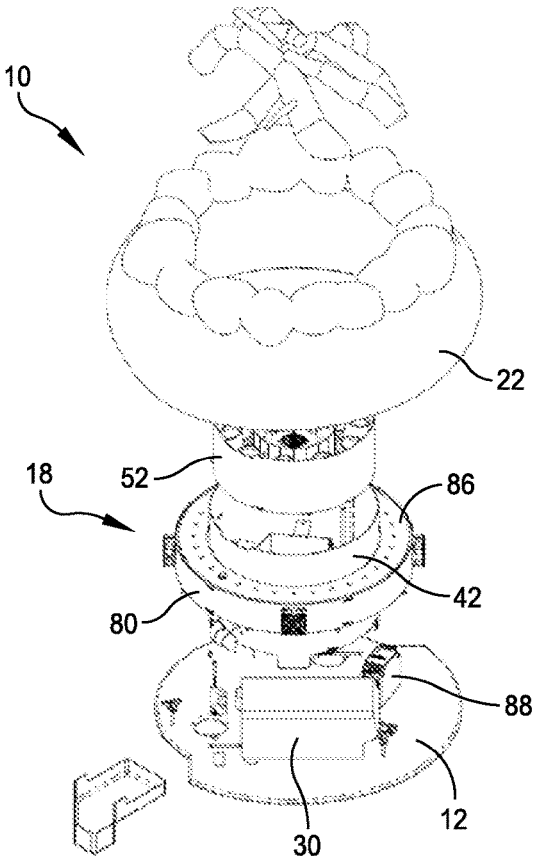
FIG. 1C is an exploded view of the embodiment of the special effect device shown in FIGS. 1A and 1B.
Figure 1D:
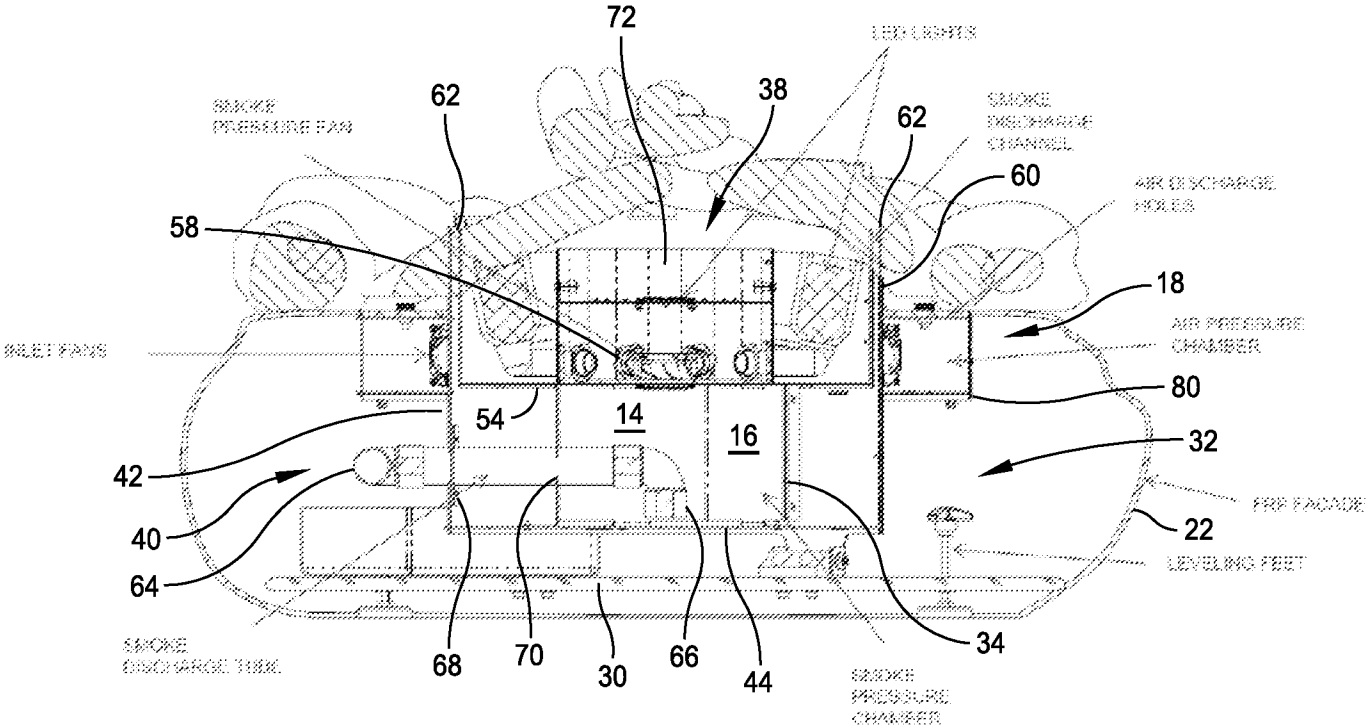
FIG. 1D is a cross-sectional view of the embodiment of the special effect device shown in FIGS. 1A and 1B.
Figure 2A:
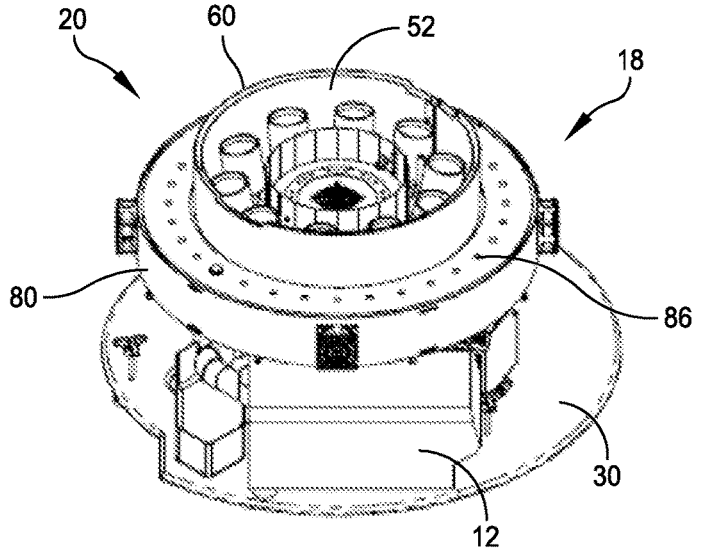
FIGS. 2A-2C respectively are perspective, top, and side views of the special effect device shown in FIGS. 1A and 1B without the exterior "skin" that causes the device to appear as a campfire.
Figure 2B:
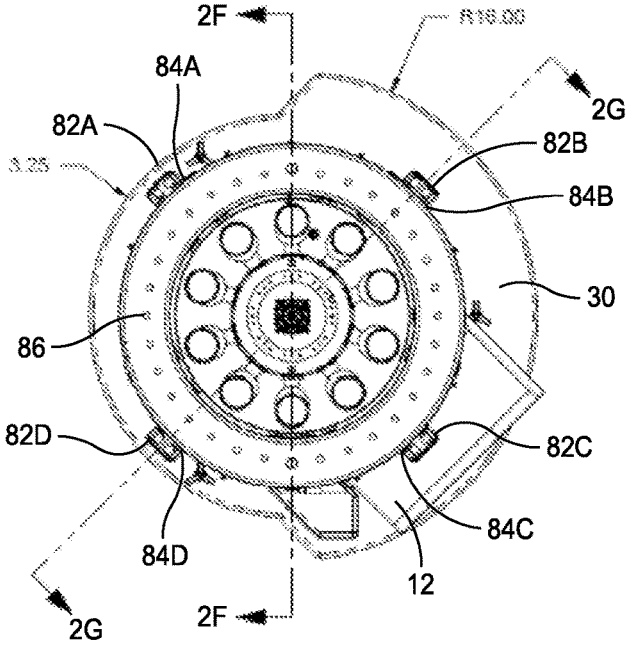
Figure 2C:
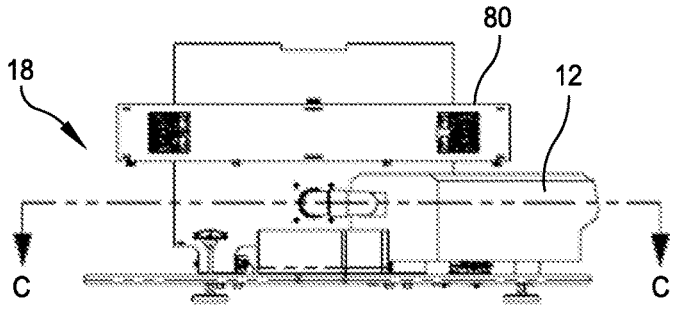
Figure 2D:
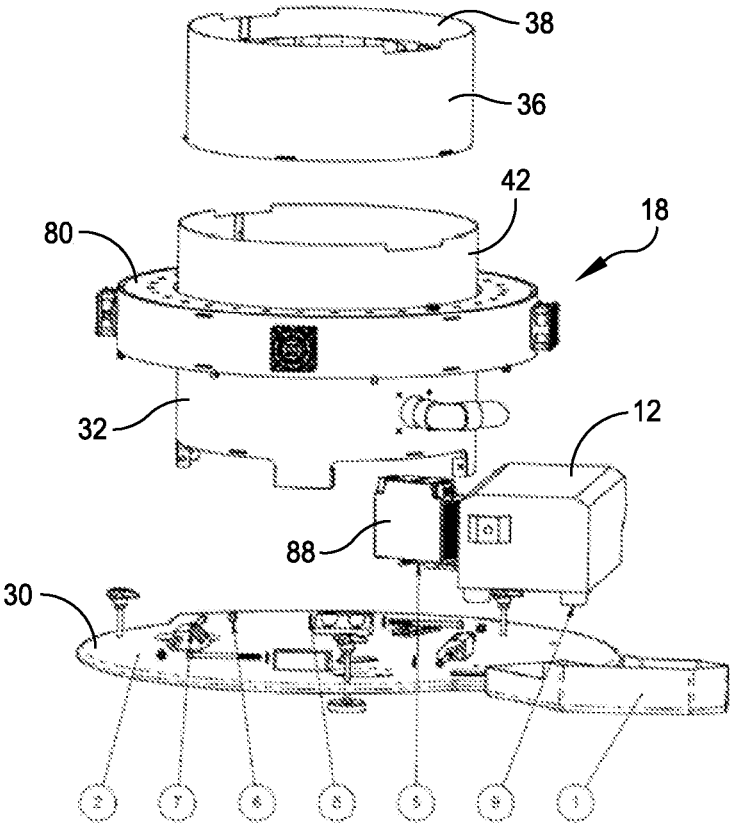
FIG. 2D is an exploded view of the special effect device, as shown in FIGS. 2A-2C.
Figure 2E:
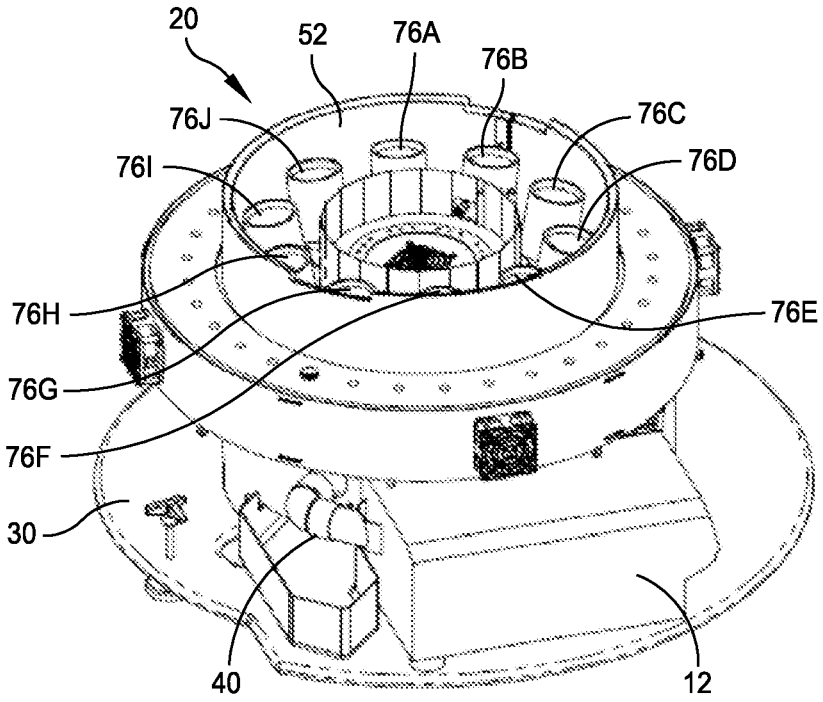
FIG. 2E is a perspective view of the special effect device shown in FIGS. 2A-2C.
Figure 2F:
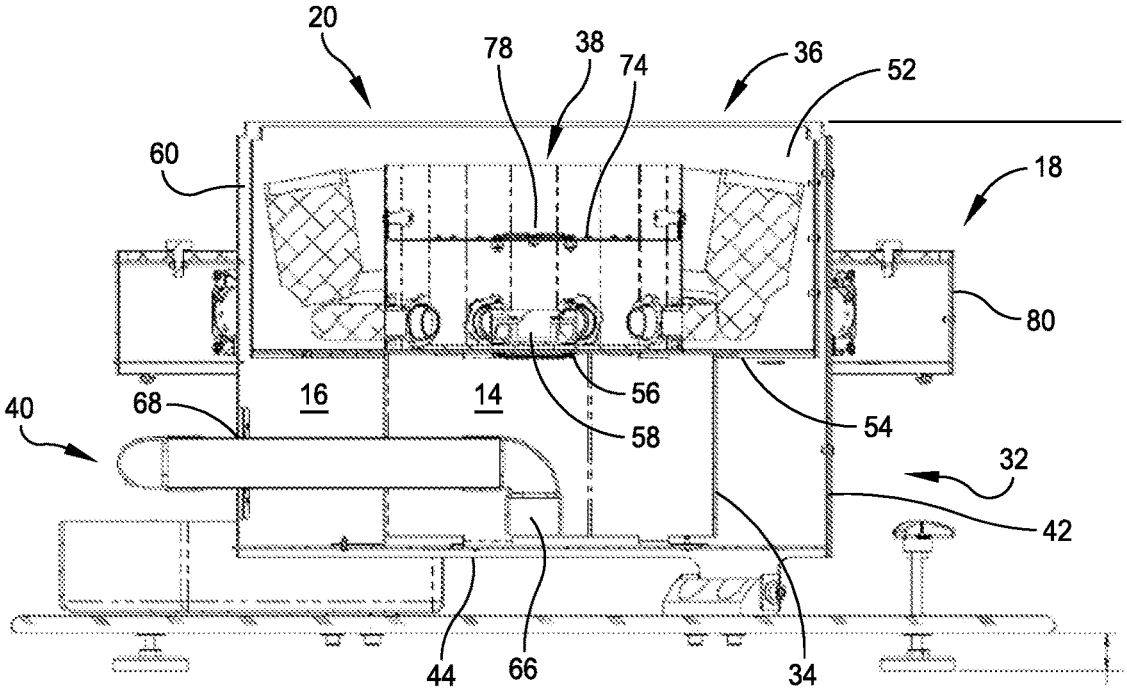
FIGS. 2F-2G are cross-sectional views of the special effect device, as shown in FIGS. 2A-2C.
Figure 2G:
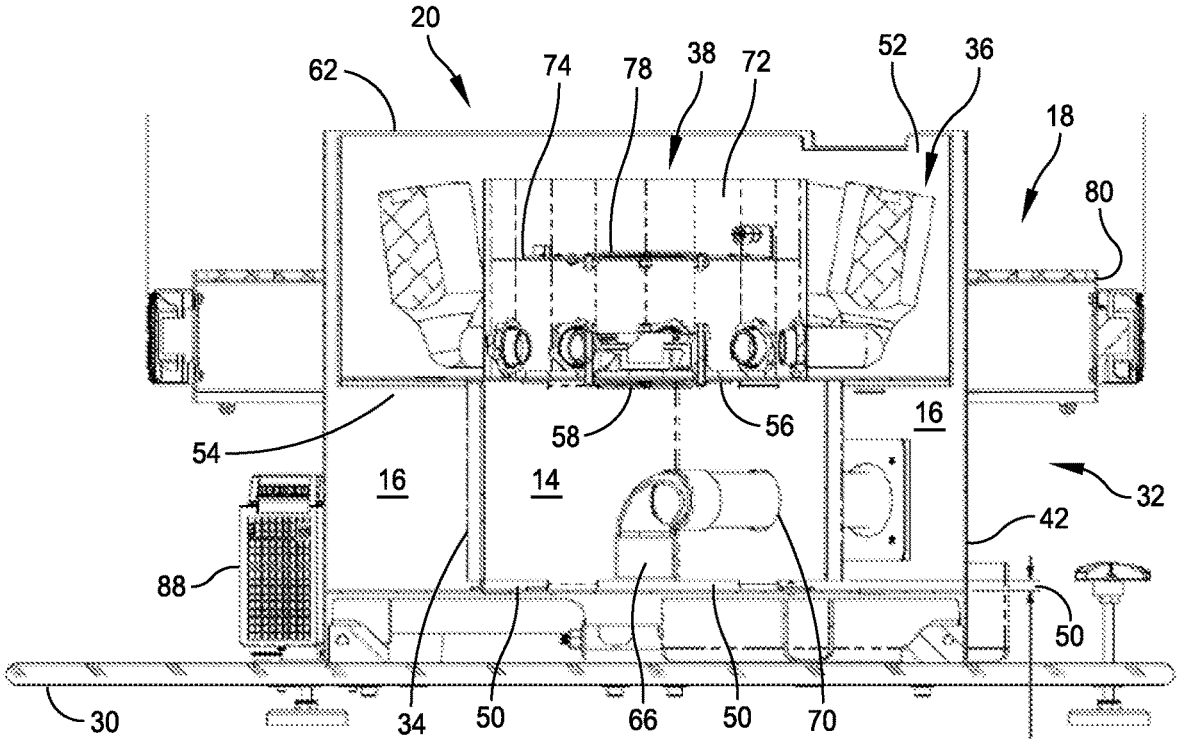

With reference to FIGS. 1A-1D and 2A-2G, an embodiment of a special effect device 10, which is hereinafter referred to as device 10, that uses theatrical smoke to produce a simulated flame or fire effect is described. Generally, the device 10 includes a theatrical smoke generator 12, a smoke distributor and pressurizer chamber 14 (hereinafter chamber 14), a smoke curtain chamber 16 (hereinafter chamber 16), a smoke curtain disrupter system 18, a light system 20, and an outer skin 22 that conveys the appearance of the wood and rocks that might be associated with a campfire. Generally, operation of the device 10 involves the production of theatrical smoke by the smoke generator 12 and the reception of the produced smoke in the chamber 14. The chamber 14 operates to distribute the smoke over a 360° angular extent and apply pressure to the smoke so as to move the smoke into the smoke curtain chamber 16. The smoke curtain chamber 16 operates so that the smoke received from the chamber 14 is directed so as to produce a relatively thin curtain of upwardly extending smoke over a 360° angular extent. The smoke curtain disrupter system 18 operates to produce moving air that is applied to the thin curtain of upwardly extending smoke produced by the smoke curtain chamber 16 so as to disrupt the curtain of smoke, thereby causing the smoke to move in a manner similar to the movement associated with an actual flame or fire. The light system 20 produces light of a desired color or colors that is applied to the curtain of smoke exiting the chamber 16 so as to simulate the color or colors of an actual fire or flame. For the simulation of a campfire, the light system 18 produces red-orange light and yellow light with the red-orange light applied to the lower portion of the smoke curtain and the yellow light applied upper portion of the smoke curtain. However, a different color or combination of colors can be produced and applied to the curtain of smoke, if needed or desired.

With continuing reference to FIGS. 1A-1D and 2A-2F, the device 10 is described in greater detail. The device 10 includes a base 30 for engaging a ground surface and supporting other elements of the device, an outer housing 32 that is supported by the base 10, a lower inner housing 34 that is supported by the outer housing 32, an upper inner housing 36, a light housing 38, and a conduit 40 for transporting theatrical smoke from the smoke generator 12 into the chamber 14. The outer housing 32 includes a side wall 42 and a bottom wall 44. The lower inner housing 34 has five side walls 48A-48E and is supported such that bottom edge of each of the side walls is spaced a small distance from the bottom wall 44 of the outer housing 32 so as to define a gap 50. The upper inner housing 36 includes a side wall 52 and a bottom wall 54. The bottom wall 54 defines an opening 56 for accommodating a fan 58 that is used to pressurize the housing 14.

The smoke distribution and pressurizer chamber 14 is formed from the inner lower housing 34, a portion of the bottom wall 44 of the outer housing 32, and a portion of the bottom wall 54 of the upper inner housing 36.

The smoke curtain chamber 16 if formed by the side wall 42 of the outer housing 32, a portion of the bottom wall 44 of the outer housing 32, the side walls 48A-48E of the lower inner housing 34, the side wall 52 of the upper inner housing 36, and a portion of the bottom wall 54 of the upper inner housing 36. A portion of the side wall 42 of the outer housing 32 and the side wall 52 of the upper inner housing 36 define a slot 60 with a 360° extent and an outlet port 62. In operation, the slot 60 receives theatrical smoke and conforms the smoke so that the smoke exiting the outlet port 62 extends upwardly in a thin curtain in the absence of obstructions above, or disturbances to the atmosphere above, the outlet port 62.

The conduit 40 extends from a first end 64 that is operatively engaged to the smoke generator 12 to a second end 66 that is disposed in the chamber 14. In the illustrated embodiment, the conduit 40 extends through a first hole 68 in the outer housing 32 and through a second hole 70 in the lower inner housing 34. If needed or desired, any gap between the conduit 40 and the outer housing 32 and any gap between the conduit 40 and the lower inner housing 34 can be closed with sealant, gaskets, or other devices known to those skilled in the art. The second end 66 of the conduit 40 is disposed in the chamber so that the theatrical smoke exiting the conduit is directed at the bottom wall 44 of the outer housing 32 and directed at a location that is approximately the geometric center of the pentagon defined by the sides wall 48A-48E of the lower inner housing 34 or the circle defined by the side wall 42 of the outer housing 32.

The light housing 38 includes a side wall 72 and a porous cross-wall 74 that each serve to support a number of light fixtures. More specifically, the light housing 38 supports high-intensity LED light fixtures 76A-76J that are substantially located between the light housing 38 and the side wall 52 of the upper inner housing 36. Further, the porous cross-wall 74 of the light housing 38 supports one or more high-intensity LED light fixtures 78. The porous cross-wall 74 is sufficiently porous so that the fan 58 can draw air from the ambient environment through the wall and apply this air to the pressurization of the chamber 14.

The device 10 further includes a toroidal housing 80 that engages the outer surface of the side wall 42 of the outer housing 32 and four fans 82A-82D. The toroidal housing 80 defines four fan ports 84A-84D that respectively conduct the air streams produced by the fans 82A-82D into the housing and a number of discharge holes 86 for discharging air from within the housing in a direction that can be used to disrupt the thin curtain of theatrical smoke produced adjacent to the outlet port 62 of the slot 60. In operation, the fans 82A-82D serve to inject sufficiently pressurized air into the interior of the housing 80 so that roughly equal streams of air exit the discharge ports 86. In operation, the steams of air coming out of the discharge holes 86 interact with portions of the outer skin (e.g., the simulated logs and rocks) so as to produce a flow of air that disrupts the curtain of smoke produced at the outlet port 62 of the slot in a manner that substantially simulates a real fire or flame.

The device 10 further includes a power supply 88 for providing power to the smoke generator 12, fan 58, the lights 76A-76J, light(s) 78, and fans 82A-82D.

In operation, the smoke generator 12 produces smoke that is injected into the chamber 14. The conduit 40 causes the injection of the smoke into the chamber 14 to be directed at the bottom wall 44 of the outer housing 32 and substantially in the center of the area defined by the side walls 48A-48E of the lower inner housing 34. The pressurizing stream of air produced by the fan 58 and injected into the chamber 14 results in a roughly even distribution of the theatrical smoke through the gap 50 and into the chamber 16. Due to the pressure produced by the fan 58, the theatrical smoke is driven towards and through the slot 60 such that a thin curtain of smoke is produced adjacent to the outlet port 62 of the slot. The lights 76A-76J and 78 are used to project the desired color or colors of the light onto the curtain of smoke so as to simulate a flame or fire. Further, the fans 82A-82D and the toroidal housing 80 operate to produce streams of air around and adjacent to the outlet port 62 of the slot that disrupt the curtain of smoke in a fashion that simulates a flame or fire.

It should be appreciated that the various chambers and housings associated with the device 10 can be realized in a number of different ways. Further, the orientation and/or size of various elements of the device 10 can be altered to accommodate a particular application. For instance, an outer skin that simulates a structure, such as a house, could be employed in place of the campfire simulating outer skin 22. Alternatively, the outer skin 22 could be eliminated in certain applications in which the device need only be positioned adjacent to some other structure to be effective.

Figure 3A:
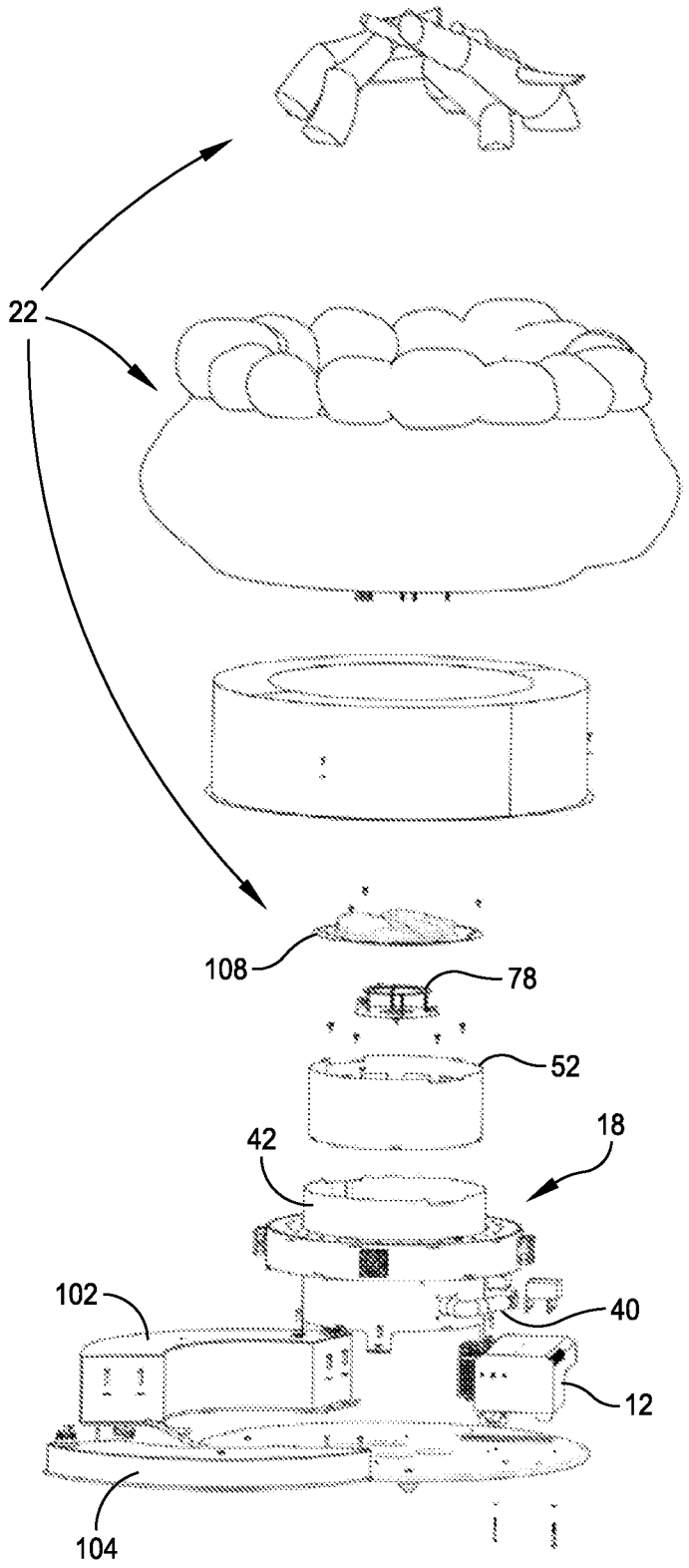
FIGS. 3A-3C respectively are an exploded view, perspective view, and cross-sectional view of a second embodiment of a device for creating a flame effect using theatrical smoke.
Figure 3B:
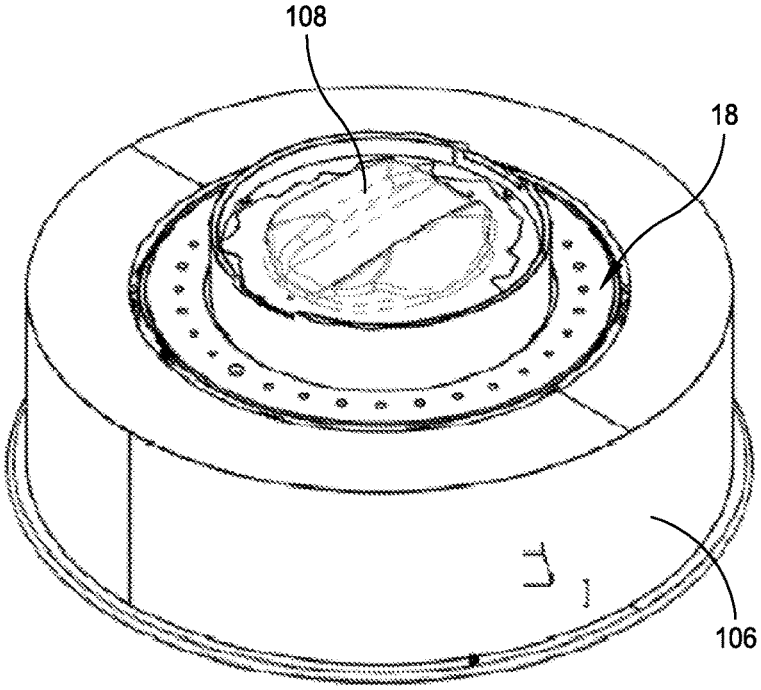
Figure 3C:
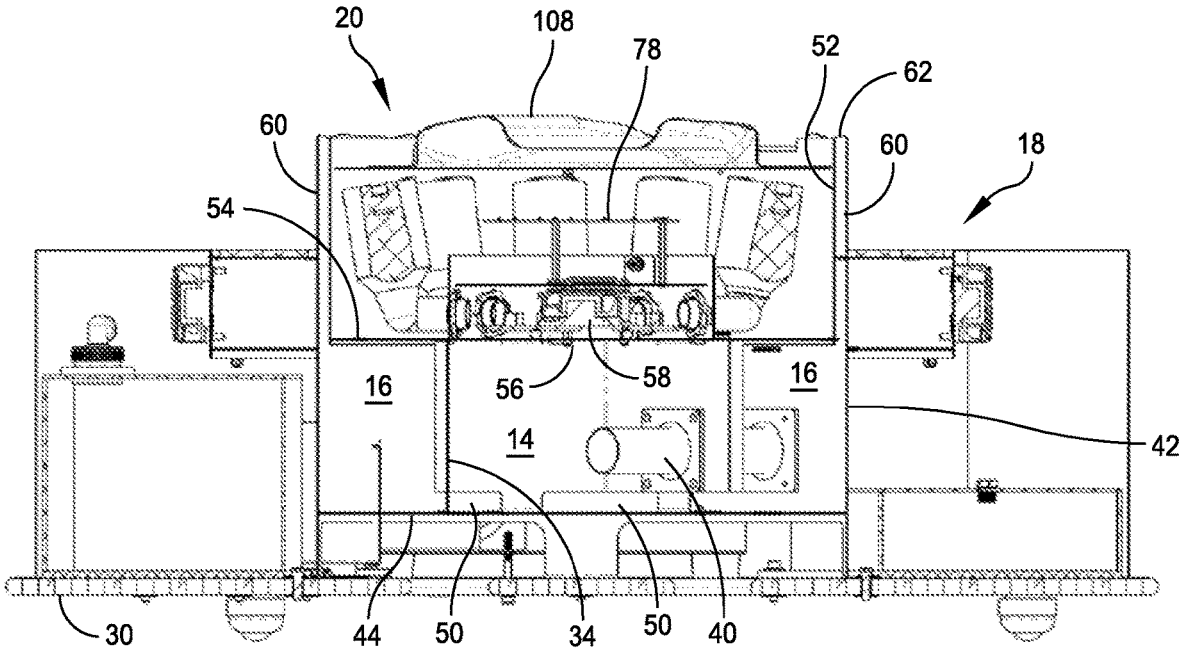

With references to FIGS. 3A-3C, a second embodiment of a special effect device that uses theatrical smoke to produce a simulated flame or fire effect, hereinafter device 100, is described. Device 100 has many of the same elements as are in device 10. Consequently, elements of device 100 that substantially correspond to elements in device 10 will be given the same reference numbers. Device 100 includes a smoke distributor and pressurizer chamber 14 (hereinafter chamber 14), a smoke curtain chamber 16 (hereinafter chamber 16), a smoke curtain disrupter system 18, a light system 20, and an outer skin 22 that conveys the appearance of the wood and rocks that might be associated with a campfire (skins that have the appearance of some kind of fire event other than a campfire are feasible). Further, the chamber 14 receives theatrical smoke that is conveyed from a theatrical smoke generator 12 to the chamber 14 via a conduit or pipe 40. A fan 58 that causes air to pass through an opening 56 into the chamber 14 is used to pressurize the chamber so as to force the theatrical smoke received within the chamber 14 to move from chamber 14 to chamber 16 via a gap 50 and on into an annular slot 60. The theatrical smoke exits the annular slot 60 at an annular output port 62 as an annular sheet of theatrical smoke. The smoke disrupter system 18 is used to modulate the annular sheet of theatrical smoke that exits the output port 62 so that the theatrical smoke takes on the "shape" of the flame or flames associated with a campfire, which is a wavy shape that tends to vary or change over time. Further, the light system 20 is used to project appropriately colored light onto the annular sheet of theatrical smoke exiting the output port 62 so as to have the color or colors of a campfire flame.

The device 100 includes a side wall 42 which forms a closed-loop, a bottom wall 44 that engages the side wall 42, a side wall 52 that forms a closed-loop, and a bottom wall 54 that engages the side wall 52. These side and bottom walls collectively encompass the spaces defined by the chamber 14 and the chamber 16, including the portion of chamber 16 that defines the slot 60. The side wall 34, which also forms a closed-loop, separates chamber 14 from chamber 16. Due to the closed-loop nature of the side wall 34 and the side wall 42, the chamber 16 surrounds the chamber 14. As such, chamber 16 can be characterized as an annular chamber. Notably, the bottom wall 44 is a bottom wall for both the chamber 14 and chamber 16. Further, the top wall 54 is a top wall for both the chamber 14 and the chamber 16. It should be appreciated that chambers that are separated from one another by a greater distance and with separate top walls and bottom walls are feasible. In such an embodiment, an additional wall located between side wall 42 and side wall 34 would likely be needed to define the extent of chamber 16. Further, the gap 50 would lengthen and likely have a more toroidal-type of shape that would require an annular structure extending between separated chambers 14 and 16.

The device 100 includes a number of structures that are not discussed with respect to device 10. Among these structures is a tank 102 for storing the liquid used by the theatrical smoke generator 12 to create theatrical smoke and providing the liquid to the generator as needed. Further, the device 100 includes a tank 104 for collecting spent theatrical smoke that has precipitated within the chambers 14 and 16 and drained out through a hole in the bottom wall 44 to be collected in the tank 104. Further, the device 100 includes a shroud 106 that engages the base 30 of the device 100. The device 100 also includes a portion of the skin 22 that simulates a bed of embers, hereinafter ember portion 108. The ember portion 108 is made of a translucent plastic material that is appropriately shaped and colored to imitate a bed of embers. In operation, the bank of LED lights 78 projects light onto the underside of the ember portion 108. Due to colored nature of the ember portion 108, the ember portion 108 appears to have the correct color or colors of a bed of embers even though the LED lights 78 project white light onto the underside of the ember portion. The device 100 also includes a sound box 110 that is adapted to provide an audio signal of the "crackling" sounds associated with a campfire to a speaker. The sound box 110 can be adapted to provide the sounds associated with different fire effects, if needed or desired. Further, the fans associated with the disrupter system 18 are adapted to receive scent packets that provide a "burning campfire" scent that is dispersed by the disrupter system 18. Packets that provide the other types of scents (e.g., barbecue) are also feasible. It should be appreciated that device 10 and other embodiments of such devices can be modified to include these elements. Also, it should be noted that the end of the conduit/pipe 40 located within the chamber 14 does not direct theatrical steam at the bottom wall 44, as in device 10.

With references to FIGS. 4A-4E, an embodiment of a special effect device that uses steam to produce a simulated flame or fire effect, hereinafter device 200, is described. Device 200 has many of the same elements as are in devices 10 and 100. Consequently, elements of device 200 that substantially correspond to elements in device 10 or device 100 will be given the same reference numbers. Device 200, because steam is used in creating a simulated flame effect, does not include many of the theatrical smoke elements present in devices 10 and 100. Among the elements present in devices 10 and 100 that are not present in device 200 are a theatrical smoke generator 12, a tank 102 for storing the liquid used by the theatrical smoke generator 12 to create theatrical smoke, and a tank 104 for collecting spent theatrical smoke.

While the elements of device 200 that substantially correspond to the elements of devices 10 and 100 have been given the same reference numbers, it should be appreciated that several of these elements have been renamed so to be identified as steam-related elements rather than smoke-related elements. The device 200 a steam distribution chamber 14 (hereinafter chamber 14), a steam curtain chamber 16 (hereinafter chamber 16), a steam curtain disrupter system 18, a light system 20, and an outer skin 22 that conveys the appearance of the wood and rocks that might be associated with a campfire (skins that have the appearance of some kind of fire event other than a campfire are feasible). Further, the chamber 14 receives steam that is conveyed from a boiler (not shown) to the chamber 14 via a conduit or pipe 40. The energy embodied in the steam received in the chamber 14 is sufficient to move the steam from the chamber 14 to the chamber 16 via a gap 50 and on into an annular slot 60. As such, device 200 also does not include the fan 58 of devices 10 and 100. The steam exits the annular slot 60 at an annular output port 62 as an annular sheet of steam. The steam disrupter system 18 is used to modulate the annular sheet of steam that exits the output port 62 so that the theatrical smoke takes on the "shape" of the flame or flames associated with a campfire, which is a wavy shape that tends to vary or change over time. Further, the light system 20 is used to project appropriately colored light onto the annular sheet of theatrical smoke exiting the output port 62 so as to have the color or colors of a campfire flame.

The device 200 includes a side wall 42 which forms a closed-loop cylinder, a bottom wall 44 that engages the side wall 42, a side wall 52 that forms a closed-loop, and a bottom wall 54 that engages the side wall 52. These side and bottom walls collectively encompass the spaces defined by the chamber 14 and the chamber 16, including the portion of chamber 16 that defines the slot 60. The side wall 34, which also forms a closed-loop, separates chamber 14 from chamber 16. Due to the closed-loop nature of the side wall 34 and the side wall 42, the chamber 16 surrounds the chamber 14. As such, chamber 16 can be characterized as an annular chamber. Notably, the bottom wall 44 is a bottom wall for both the chamber 14 and chamber 16. Further, the top wall 54 is a top wall for both the chamber 14 and the chamber 16. It should be appreciated that chambers that are separated from one another by a greater distance and with separate top walls and bottom walls are feasible. In such an embodiment, an additional wall located between side wall 42 and side wall 34 would likely be needed to define the extent of chamber 16. Further, the gap 50 would lengthen and likely have a more toroidal-type of shape that would require an annular structure extending between separated chambers 14 and 16.

Figure 4A:
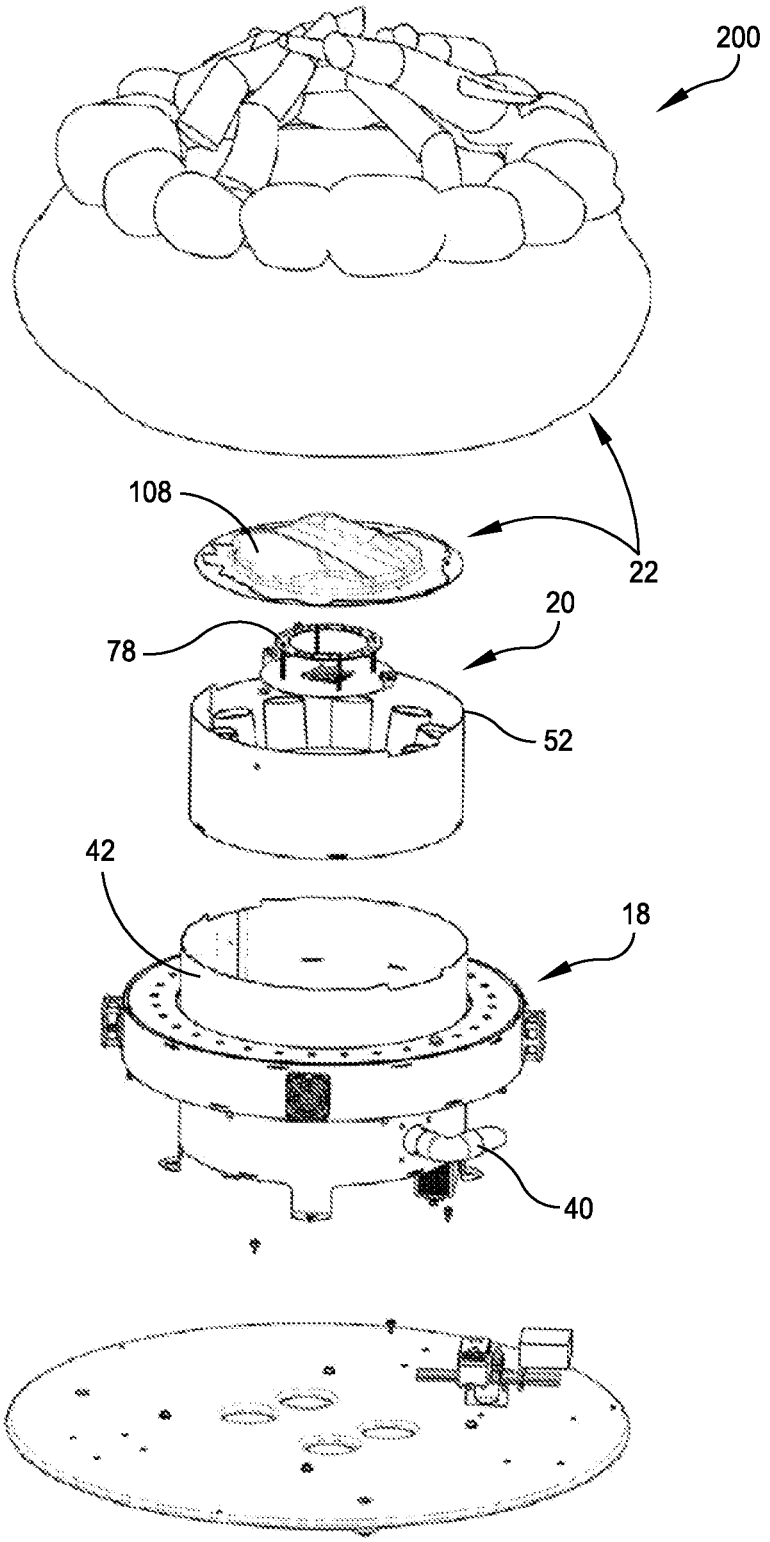
FIGS. 4A-4E respectively are an exploded view, perspective view, side view, side cross-sectional view, and vertical cross-section view of an embodiment of device for creating a flame effect using steam.
Figure 4B:
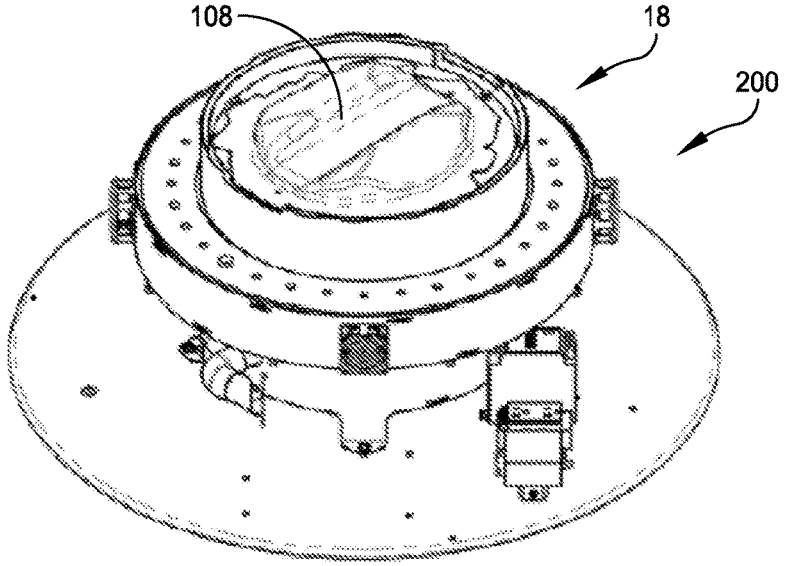
Figure 4C:
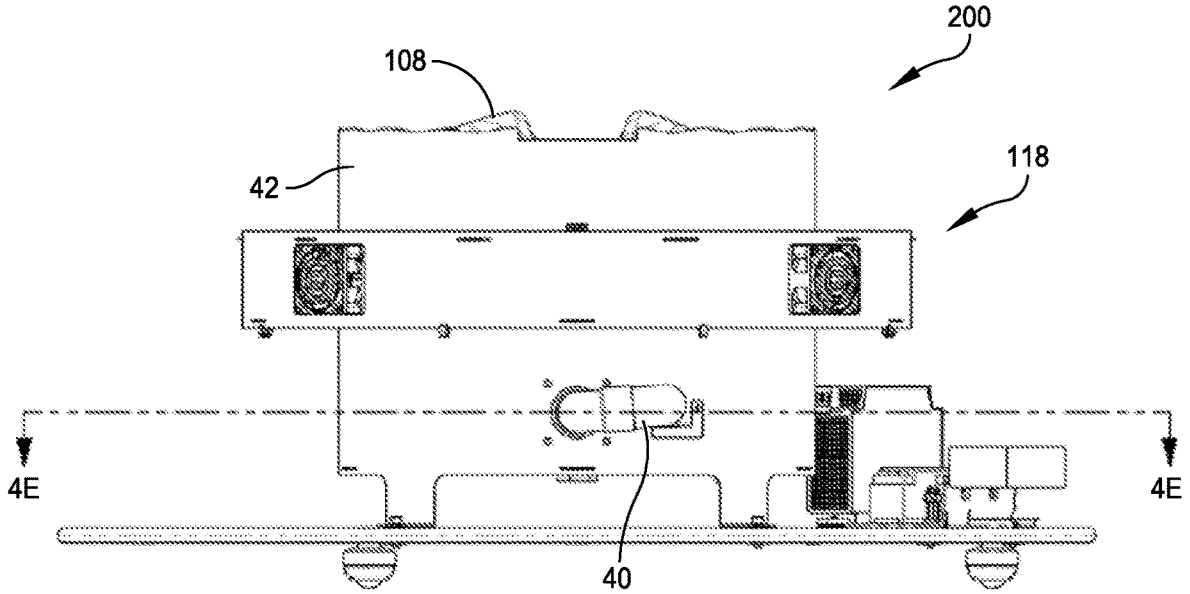
Figure 4D:
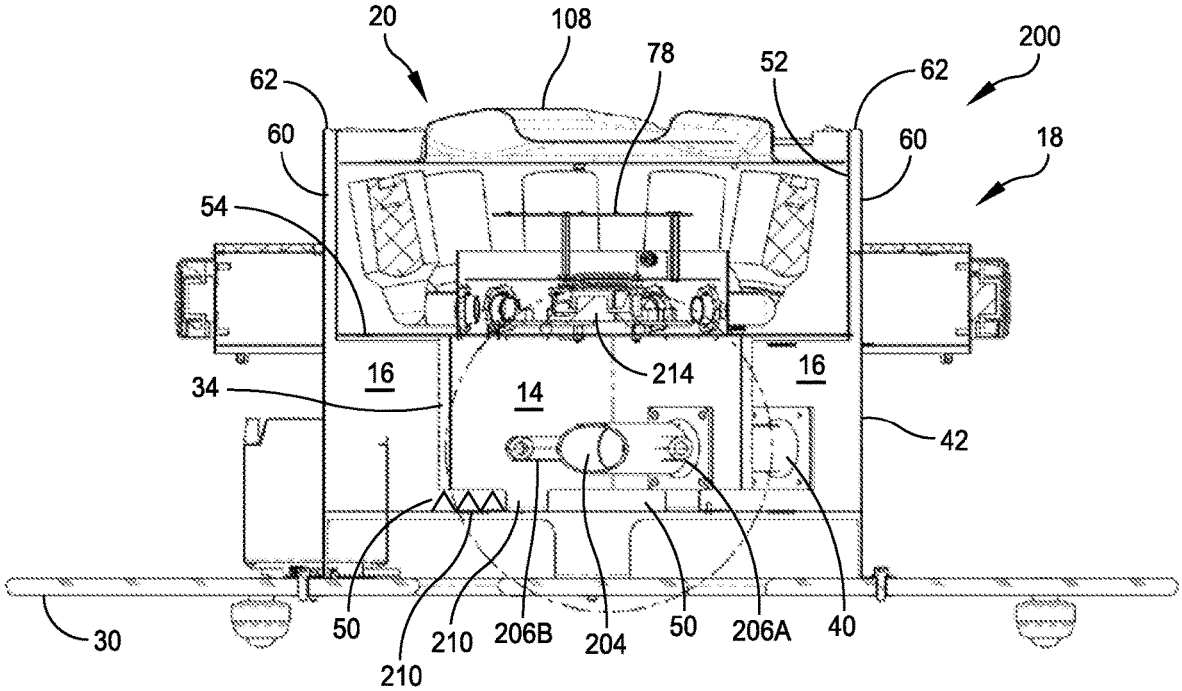
Figure 4E:
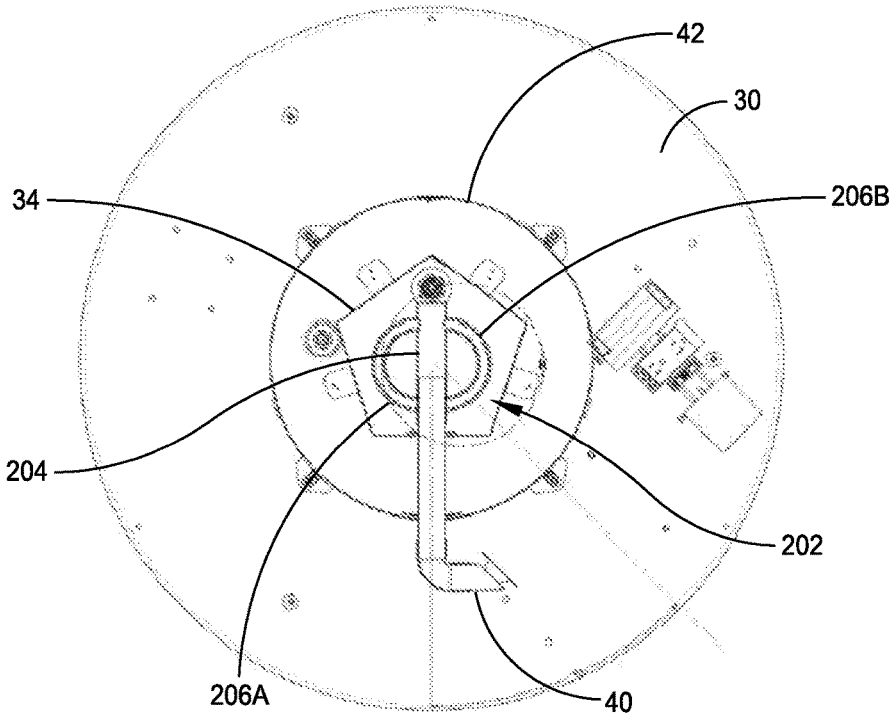

The device 200 also includes a steam manifold 202 for injecting steam into the chamber 14. The manifold 202 has a Φ-shape with a main tube 204 and two, curved tubes 206A, 206B that each have multiple laterally extending orifices for venting steam into the chamber 14 at multiple locations in the chamber 14 to facilitate a relatively even distribution of steam within the chamber 14. It is believed that steam manifolds with other shapes are feasible, provided the manifold multiple orifices that disperse the steam at multiple locations throughout the chamber 14. The device 200 also includes a portion of the skin 22 that simulates a bed of embers, hereinafter ember portion 108. The ember portion 108 is made of a translucent plastic material that is appropriately shaped and colored to imitate a bed of embers. In operation, the bank of LED lights 78 projects light onto the underside of the ember portion 108. Due to colored nature of the ember portion 108, the ember portion 108 appears to have the appropriate color or colors of a bed of embers even though the LED lights 78 project white light onto the underside of the ember portion. Additionally, it has been found that in some embodiments of the device 200 that a flow straightener located in the gap 50 also facilitates an even distribution of steam from the chamber 14 to the chamber 16. With reference to FIG. 4D, a flow straightener 210 is located in a portion of the gap 50. The flow straightener has a triangle-wave shape. However, flow straighteners with other shapes are also feasible. As should be appreciated, the gap 50 is not continuous but is composed of sub-gaps that are separated from one another by stands 212 that support the side wall 34 and other of the overly structure. The sub-gaps define the annularly extending gap 50. In other embodiments, it may be possible to eliminate the stands 212 so that the gap is continuous. The device 200 further includes a fan 214 that is positioned to direct a flow of air at the LED lights 78 to cool the lights. While the fan 214 is in the same position as the fan 58 used in devices 10 and 100, the fan 214 does not cause air to be injected into the chamber 14.

The foregoing description of the invention is intended to explain the best mode known of practicing the invention and to enable others skilled in the art to utilize the invention in various embodiments and with the various modifications required by their particular applications or uses of the invention.

What is claimed is:

1. A special effect device for use in creating a simulated fire effect comprising:

a pipe for conveying a stream of gas from a first terminal end of the pipe to a second terminal end of the pipe;

an inner first chamber for receiving a stream of gas from the second end of the pipe, the inner first chamber defining a first enclosed space;

wherein the second terminal end of the pipe is located in the first enclosed space;

an annular second chamber for receiving a stream of gas from the first chamber, the annular second chamber surrounding the first chamber and defining a second enclosed space that is separate from the first enclosed space, the annular second chamber defining an annular closed-loop slot for directing a closed-loop sheet of gas into the ambient atmosphere;

a passageway for conveying gas from the inner first chamber to the annular second chamber; and an air modulator configured to produce moving air, the air modulator configured to apply the moving air to the closed-loop sheet of gas exiting the annular second chamber, and the moving air of the air modulator configured to disrupt the closed-loop sheet of gas so as to cause the gas to move in a manner of movement associated with actual flame or fire.

2. A special effect device, as claimed in claim 1, wherein:

the inner first chamber includes a first upper wall, a first lower wall separated from the first upper wall, and a first side wall that forms a first closed loop and is located between the first upper wall and first lower wall.

3. A special effect device, as claimed in claim 2, wherein:

the annular second chamber includes a second upper wall, a second lower wall separated from the second upper wall, a second inner side wall that forms a second inner closed loop and is located between the second upper wall and the second lower wall, and a second outer side wall that forms a second outer closed loop and is located between the second upper wall and the second lower wall.

4. A special effect device, as claimed in claim 3, wherein:

the first side wall of the inner first chamber and the second inner side wall of the annular second chamber are joined with one another so as to form a composite side wall with an upper edge and a lower edge that is separated from the upper edge, the second enclosed space extending between the composite side wall and the second outer side wall;

the first lower wall and the second lower wall are joined with one another so as to form a composite lower wall;

wherein the lower edge of the composite side wall is separated from the composite lower wall so as to define at least a portion of the passageway for conveying gas from the inner first chamber to the annular second chamber.

5. A special effect device, as claimed in claim 4, wherein:

the passageway is a plurality of sub-passageways that collectively define a sub-passageway closed loop.

6. A special effect device, as claimed in claim 3, wherein:

a first end of the passageway is located closer to the first lower wall than to the first upper wall of the inner first chamber; and a second end of the passageway is located closer to the second lower wall than to the second upper wall of the annular second chamber.

7. A special effect device, as claimed in claim 1, further comprising:

a fan for injecting air into the inner first chamber to move gas from the inner first chamber to the annular second chamber.

8. A special effect device, as claimed in claim 2, wherein:

the second terminal end of the pipe is positioned so that gas exiting the second terminal end of the pipe is directed at the first lower wall of the inner first chamber.

9. A special effect device, as claimed in claim 8, further comprising:

a fan for injecting air into the inner first chamber to move gas from the inner first chamber to the annular second chamber, the fan adapted to cause air to move into the inner first chamber through an opening in the first upper wall.

10. A special effect device, as claimed in claim 1, further comprising:

a manifold connected to the second terminal end of the pipe and adapted to direct two or more streams of gas into the inner first chamber and away from the first lower wall.

11. A special effect device, as claimed in claim 10, wherein:

the passageway is located a first distance from the first lower wall;

the manifold is located a second distance from the first lower wall;

wherein the second distance is greater than the first distance.

12. A special effect device, as claimed in claim 1, further comprising:

an air modulator for directing air at a closed-loop sheet of gas exiting the annular closed-loop slot.

13. A special effect device, as claimed in claim 12, wherein:

the air modulator includes an annular third chamber that surround the annular second chamber, the annular third chamber defining multiple orifices with each of the multiple orifices adapted to direct a stream of air at a closed-loop sheet of gas exiting the annular closed-loop slot.

14. A special effect device, as claimed in claim 12, wherein:

the air modulator includes a fan.

15. A special effect device, as claimed in claim 13, wherein:

the air modulator includes a fan for injecting air into the annular third chamber, the fan adapted to cause air to move into the annular third chamber through an intake hole define defined by the annular third chamber and to cause air to move out of the annular third chamber through at least one of the multiple orifices.

16. A special effect device, as claimed in claim 1, further comprising:

a lighting structure adapted to project light onto a closed-loop sheet of gas exiting the closed-loop slot to create an illusion of a flame.

17. A special effect device, as claimed in claim 16, wherein:

the lighting structure includes a plurality of LED light and a fan positioned adjacent to the plurality of LED lights and, in operation, produce a stream of air to cool the plurality of LED lights.

18. A special effect device, as claimed in claim 1, further comprising:

an outer skin with at least a portion of the outer skin positioned adjacent to a portion of the annular closed-loop slot so as to affect a flow of at least a portion of a sheet of gas exiting the annular closed-loop slot.

19. A special effect device for use in creating a simulated fire effect comprising:

a pipe for conveying a stream of gas from a first terminal end of the pipe to a second terminal end of the pipe;

an inner first chamber for receiving a stream of gas from the second end of the pipe, the inner first chamber defining a first enclosed space;

wherein the second terminal end of the pipe is located in the first enclosed space;

an annular second chamber for receiving a stream of gas from the first chamber, the annular second chamber surrounding the first chamber and defining a second enclosed space that is separate from the first enclosed space, the annular second chamber further defining an annular closed-loop slot for directing a closed-loop sheet of gas into the ambient atmosphere;

a passageway for conveying gas from the inner first chamber to the annular second chamber;

an air modulator for directing air at a closed-loop sheet of gas exiting the annular closed-loop slot, the air modulator including an annular third chamber that surrounds the annular second chamber and defines multiple orifices with each of the multiple orifices adapted to direct a stream of air at a closed-loop sheet of gas exiting the annular closed-loop slot;

a lighting structure adapted to project light onto a closed-loop sheet of gas exiting the closed-loop slot.

20. A special effect device, as claimed in claim 19, further comprising: means for providing sound associated with a type of fire effect being simulated; and means for providing a scent associated with the type of fire effect being simulated.

* * * * *